US012371231B2

(12) United States Patent
Gauthey

(10) Patent No.: US 12,371,231 B2
(45) Date of Patent: Jul. 29, 2025

(54) CONTAINER CLOSURE

(71) Applicant: ALPLA WERKE ALWIN LEHNER GMBH & CO. KG, Hard (AT)

(72) Inventor: Michel Gauthey, Dijon (FR)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 207 days.

(21) Appl. No.: 17/438,863

(22) PCT Filed: Mar. 13, 2020

(86) PCT No.: PCT/EP2020/056947

§ 371 (c)(1),
(2) Date: Sep. 13, 2021

(87) PCT Pub. No.: WO2020/187781

PCT Pub. Date: Sep. 24, 2020

(65) Prior Publication Data

US 2022/0144500 A1 May 12, 2022

(30) Foreign Application Priority Data

Mar. 15, 2019 (CH) ..... 00326/19

(51) Int. Cl.
*B65D 41/34* (2006.01)
*B65D 5/74* (2006.01)
*B65D 55/16* (2006.01)

(52) U.S. Cl.
CPC ..... *B65D 41/3447* (2013.01); *B65D 5/746* (2013.01); *B65D 55/16* (2013.01); *B65D 2401/30* (2020.05)

(58) Field of Classification Search
CPC ..... B26F 2210/04; B29C 2949/0777; B29C 2949/0815; B29C 2949/0824;
(Continued)

(56) References Cited

U.S. PATENT DOCUMENTS 2,039,385 A 5/1936 Bonhomme
4,567,991 A * 2/1986 Anderson ..... B65D 41/3409 215/256

(Continued)

FOREIGN PATENT DOCUMENTS

DE 9318243 U1 2/1994
DE 102007010786 A1 9/2008

(Continued)

*Primary Examiner* — Anthony D Stashick
*Assistant Examiner* — Marcos Javier Rodriguez Molina
(74) *Attorney, Agent, or Firm* — MORRISS O'BRYANT COMPAGNI CANNON, PLLC

(57) ABSTRACT

A container closure includes a pouring element that merges into a container body or fastened on a container body and has at least one external thread formed on the pouring element. A closure cap for closing a pouring opening of the pouring element has a cylindrical threaded part with an open periphery and an internal thread that interacts with the external thread of the pouring element. The closure cap has a tamper-evident band connected to the open periphery of the threaded part by a plurality of breaking lugs. Opening of the container closure for the first time is evident from the breaking of the breaking lugs. The tamper-evident band has a first end fixed to the open periphery of the threaded part and a second end that can be connected to the pouring element.

23 Claims, 6 Drawing Sheets

(58) Field of Classification Search

Figure 1:
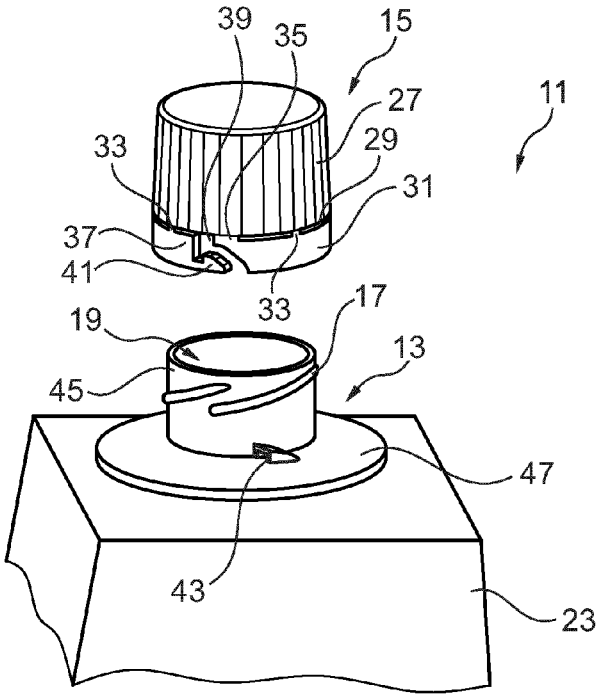

CPC .... B29C 2949/0833; B29C 2949/0843; B29C 2949/0853; B65B 13/22; B65B 19/04; B65B 19/10; B65B 19/20; B65B 19/24; B65B 19/28; B65B 2051/105; B65B 25/143; B65B 3/04; B65B 31/003; B65B 41/12; B65B 51/14; B65B 51/225; B65B 55/06; B65B 55/10; B65B 57/10; B65B 57/14; B65B 61/025; B65B 61/205; B65B 7/18; B65C 1/02; B65C 1/021; B65C 1/023; B65C 1/045; B65C 11/0289; B65C 2210/0018; B65C 3/14; B65C 3/16; B65C 3/18; B65C 3/22; B65C 9/0006; B65C 9/02; B65C 9/04; B65C 9/08; B65C 9/105; B65C 9/14; B65C 9/16; B65C 9/18; B65C 9/1819; B65C 9/1865; B65C 9/1884; B65C 9/2291; B65C 9/25; B65C 9/26; B65C 9/28; B65C 9/36; B65C 9/40; B65C 9/42; B65C 9/46; B65D 1/02; B65D 1/0207; B65D 1/0215; B65D 1/0223; B65D 1/023; B65D 1/0246; B65D 1/0261; B65D 1/0276; B65D 1/0284; B65D 1/04; B65D 1/06; B65D 1/08; B65D 1/12; B65D 1/16; B65D 1/165; B65D 1/18; B65D 1/20; B65D 1/26; B65D 1/30; B65D 1/40; B65D 1/42; B65D 11/04; B65D 11/06; B65D 15/02; B65D 15/06; B65D 15/08; B65D 15/22; B65D 15/24; B65D 17/00; B65D 17/4011; B65D 19/0006; B65D 19/06; B65D 19/08; B65D 19/10; B65D 19/385; B65D 19/40; B65D 19/44; B65D 21/0209; B65D 21/0213; B65D 21/0219; B65D 21/022; B65D 21/023; B65D 21/0233; B65D 2205/00; B65D 2213/00; B65D 2213/02; B65D 2231/001; B65D 2251/0021; B65D 2251/0028; B65D 2251/009; B65D 2251/0093; B65D 2251/1016; B65D 2251/1025; B65D 2251/105; B65D 2251/1058; B65D 2251/205; B65D 2275/00; B65D 23/00; B65D 23/04; B65D 23/0814; B65D 2301/20; B65D 2313/02; B65D 2313/08; B65D 2313/10; B65D 2401/00; B65D 2401/15; B65D 2401/30; B65D 2401/45; B65D 2401/50; B65D 25/02; B65D 25/108; B65D 25/14; B65D 25/20; B65D 25/22; B65D 25/24; B65D 25/28; B65D 25/2802; B65D 25/2826; B65D 25/34; B65D 25/36; B65D 25/42; B65D 25/56; B65D 2501/0081; B65D 2519/00024; B65D 2519/00034; B65D 2519/00059; B65D 2519/00069; B65D 2519/00079; B65D 2519/00094; B65D 2519/00104; B65D 2519/00129; B65D 2519/00164; B65D 2519/00174; B65D 2519/00199; B65D 2519/00208; B65D 2519/00233; B65D 2519/00268; B65D 2519/00273; B65D 2519/00288; B65D 2519/00318; B65D 2519/00333; B65D 2519/00338; B65D 2519/00373; B65D 2519/00407; B65D 2519/00412; B65D 2519/00502; B65D 2519/00512; B65D 2519/00537; B65D 2519/00552; B65D 2519/00562; B65D 2519/00567; B65D 2519/00572; B65D 2519/00621; B65D 2519/00666; B65D 2519/00711; B65D 2519/008; B65D 2519/00815; B65D 2519/0083; B65D 2539/008; B65D 2543/00027; B65D 2543/00092; B65D 2543/00101; B65D 2543/00138; B65D 2543/00148; B65D 2543/00194; B65D 2543/00296; B65D 2543/00351; B65D 2543/00407; B65D 2543/00416; B65D 2543/00435; B65D 2543/005; B65D 2543/00509; B65D 2543/00518; B65D 2543/00527; B65D 2543/00537; B65D 2543/00546; B65D 2543/00555; B65D 2543/00564; B65D 2543/00601; B65D 2543/00648; B65D 2543/00666; B65D 2543/00694; B65D 2543/00759; B65D 2543/00768; B65D 2543/00805; B65D 2543/00851; B65D 2543/00972; B65D 2543/00981; B65D 2543/0099; B65D 2547/06; B65D 2555/00; B65D 2575/583; B65D 2577/2083; B65D 2577/2091; B65D 2590/0066; B65D 27/00; B65D 3/04; B65D 3/12; B65D 3/30; B65D 31/00; B65D 31/02; B65D 33/065; B65D 33/10; B65D 33/16; B65D 33/20; B65D 33/2516; B65D 33/2533; B65D 33/2585; B65D 35/02; B65D 35/08; B65D 35/28; B65D 37/00; B65D 39/08; B65D 39/086; B65D 39/088; B65D 39/16; B65D 41/00; B65D 41/04; B65D 41/045; B65D 41/0471; B65D 41/083; B65D 41/17; B65D 41/20; B65D 41/32; B65D 41/34; B65D 41/3404; B65D 41/3409; B65D 41/34114; B65D 41/3419; B65D 41/3423; B65D 41/3428; B65D 41/3433; B65D 41/3438; B65D 41/3442; B65D 41/3447; B65D 41/3452; B65D 41/3457; B65D 41/3461; B65D 41/3471; B65D 41/348; B65D 41/349; B65D 41/3495; B65D 43/02; B65D 43/0202; B65D 43/021; B65D 43/0212; B65D 43/0218; B65D 43/0235; B65D 43/0237; B65D 43/0241; B65D 43/0243; B65D 43/0245; B65D 43/0247; B65D 43/0252; B65D 43/0256; B65D 43/0258; B65D 43/026; B65D 43/0262; B65D 43/0264; B65D 43/027; B65D 43/0277; B65D 43/0285; B65D 43/0289; B65D 43/0291; B65D 43/0293; B65D 43/0295; B65D 43/0297; B65D 43/14; B65D 43/169; B65D 43/18; B65D 43/26; B65D 45/06; B65D 45/32; B65D 45/345; B65D 47/08; B65D 47/0842; B65D 47/0876; B65D 47/121; B65D 47/123; B65D 47/18; B65D 47/2037; B65D 5/061; B65D 5/2057; B65D 5/40; B65D 5/4216; B65D 5/4279; B65D 5/5038; B65D 5/746; B65D 50/00; B65D 50/046; B65D 51/1688; B65D 5/18; B65D 5/20; B65D 51/228; B65D 51/24; B65D 51/242; B65D 51/246; B65D 51/247; B65D 53/02; B65D 55/066; B65D 55/0827; B65D 55/089; B65D 55/16; B65D 59/02; B65D 59/06; B65D 65/22; B65D 65/40; B65D 65/466; B65D 7/045; B65D 71/0088; B65D 71/02;

B65D 71/72; B65D 75/008; B65D 75/26; B65D 75/305; B65D 75/327; B65D 75/367; B65D 5/5805; B65D 75/5811; B65D 75/5816; B65D 75/5822; B65D 75/5855; B65D 75/5883; B65D 77/0466; B65D 77/061; B65D 77/2024; B65D 77/2052; B65D 77/245; B65D 77/30; B65D 9/0084; B65D 79/02; B65D 81/18; B65D 81/2023; B65D 81/3211; B65D 81/3283; B65D 81/3461; B65D 81/3484; B65D 81/366; B65D 81/38; B65D 81/3818; B65D 81/3823; B65D 81/3837; B65D 81/3874; B65D 83/0055; B65D 83/14; B65D 83/224; B65D 83/382; B65D 83/54; B65D 83/752; B65D 83/7538; B65D 83/757; B65D 83/7575; B65D 85/24; B65D 85/70; B65D 85/72; B65D 9/12; B65D 9/24; B65D 9/30; B65D 90/004; B65D 1/1615; B65D 2240/145; B65D 3/22; B65D 1/00; B65D 1/0292; B65D 1/095; B65D 1/10; B65D 1/32; B65D 1/44; B65D 1/46; B65D 1/48; B65D 11/1873; B65D 11/20; B65D 21/0204; B65D 21/0212; B65D 1/0219; B65D 21/0237; B65D 2203/00; B65D 2203/02; B65D 2203/06; B65D 2205/02; B65D 2251/0015; B65D 2251/0025; B65D 2251/0056; B65D 2251/0078; B65D 2251/0087; B65D 2251/02; B65D 2251/04; B65D 2251/1008; B65D 2251/1041; B65D 2251/1066; B65D 2251/1083; B65D 2251/20; B65D 2255/20; B65D 23/001; B65D 23/02; B65D 23/821; B65D 23/0857; B65D 23/0864; B65D 23/10; B65D 23/102; B65D 23/104; B65D 23/106; B65D 23/12; B65D 2303/00; B65D 2401/20; B65D 2401/25; B65D 2401/40; B65D 25/2811; B65D 25/2894; B65D 25/38; B65D 25/40; B65D 25/48; B65D 25/52; B65D 2501/0009; B65D 2501/0018; B65D 2501/0027; B65D 2501/0036; B65D 2501/0063; B65D 2501/0072; B65D 2501/009; B65D 2519/0059; B65D 2519/0019; B65D 2543/00083; B65D 2543/00277; B65D 2543/00777; B65D 2547/063; B65D 2547/066; B65D 2565/381; B65D 2565/386; B65D 2565/387; B65D 2571/00209; B65D 2571/00246; B65D 2571/00469; B65D 2571/00697; B65D 2571/00716; B65D 35/00; B65D 35/20; B65D 35/24; B65D 35/42; B65D 41/005; B65D 41/0407; B65D 41/0414; B65D 41/0421; B65D 41/0428; B65D 41/0435; B65D 41/0442; B65D 41/0457; B65D 41/0485; B65D 41/06; B65D 41/086; B65D 41/16; B65D 41/165; B65D 41/185; B65D 41/26; B65D 41/325; B65D 41/3414; B65D 41/38; B65D 41/465; B65D 41/48; B65D 41/485; B65D 41/50; B65D 41/62; B65D 43/0231; B65D 43/16; B65D 43/162; B65D 47/00; B65D 47/02; B65D 47/043; B65D 47/06; B65D 47/065; B65D 47/0804; B65D 47/0809; B65D 47/0814; B65D 47/0819; B65D 47/0823; B65D 47/0828; B65D 47/0838; B65D 47/0857; B65D 47/0866; B65D 47/088; B65D 47/10; B65D 47/103; B65D 47/12; B65D 47/122; B65D 47/14; B65D 47/148; B65D 47/20; B65D 47/2006; B65D 47/2018; B65D 47/2031; B65D 47/2062; B65D 47/2068; B65D 47/2081; B65D 47/241; B65D 47/242; B65D 47/243; B65D 47/246; B65D 47/247; B65D 47/265; B65D 47/266; B65D 47/283; B65D 47/286; B65D 47/30; B65D 47/305; B65D 47/32; B65D 47/36; B65D 47/40; B65D 5/747; B65D 50/06; B65D 50/061; B65D 50/062; B65D 51/1661; B65D 51/18; B65D 51/20; B65D 51/224; B65D 51/225; B65D 51/226; B65D 51/245; B65D 51/28; B65D 51/2814; B65D 51/2835; B65D 55/00; B65D 55/02; B65D 55/022; B65D 55/024; B65D 55/026; B65D 55/06; B65D 55/0854; B65D 65/16; B65D 65/42; B65D 7/08; B65D 7/24; B65D 71/0007; B65D 71/0085; B65D 71/502; B65D 75/46; B65D 75/5805; B65D 75/5877; B65D 77/04; B65D 77/06; B65D 77/202; B65D 79/005; B65D 79/0084; B65D 81/24; B65D 81/26; B65D 81/266; B65D 81/3205; B65D 81/3227; B65D 81/3288; B65D 83/06; B65D 83/164; B65D 83/32; B65D 83/36; B65D 83/38; B65D 83/42; B65D 83/62; B65D 83/625; B65D 83/64; B65D 83/643; B65D 83/75; B65D 83/76; B65D 83/765; B65D 83/771; B65D 85/8046; B65G 1/0407; B65G 1/0421; B65G 1/0435; B65G 1/0492; B65G 1/06; B65G 1/08; B65G 1/1375; B65G 13/00; B65G 15/36; B65G 19/28; B65G 2201/0226; B65G 2201/04; B65G 2201/06; B65G 2203/042; B65G 2205/04; B65G 29/00; B65G 37/005; B65G 47/263; B65G 47/5154; B65G 47/82; B65G 47/846; B65G 47/8823; B65G 5/00; B65G 51/02; B65G 53/52; B65G 53/523; B65G 57/035; B65G 65/00; B65G 67/02; B65G 67/22; B65G 69/00; B65G 69/183; B65H 16/04; B65H 16/06; B65H 18/16; B65H 18/20; B65H 19/126; B65H 19/1836; B65H 19/1868; B65H 19/2246; B65H 19/2284; B65H 19/26; B65H 20/18; B65H 2220/04; B65H 23/02; B65H 23/0258; B65H 23/24; B65H 2301/4148; B65H 2301/414863; B65H 2301/415095; B65H 2301/4172; B65H 2301/41826; B65H 2301/41891; B65H 2301/4212; B65H 2301/42146; B65H 2301/46115; B65H 2301/46312; B65H 2301/4641; B65H 2402/351; B65H 2404/43; B65H 2404/432; B65H 2406/351; B65H 2511/12; B65H 2601/321; B65H 2701/173; B65H 2701/176; B65H 2701/1766; B65H 2701/192; B65H 2701/31; B65H 29/66; B65H 29/6627; B65H 29/68; B65H 31/06; B65H 31/3036; B65H 35/02;

B65H 35/08; B65H 54/40; B65H 54/42; B65H 54/52; B65H 54/543; B65H 54/70; B65H 54/82; B65H 67/04; B65H 75/08; B65H 75/185; B65H 75/2484; B67D 1/0847; B65F 1/02; B65F 1/1615; B65F 2240/145; B65F 3/22

USPC ..... 206/0.5, 0.6, 222, 223, 256, 3, 304, 206/316.1, 316.2, 335, 336, 339, 340, 206/348, 368, 380, 383, 386, 405, 407, 206/413, 416, 438, 446, 449, 454, 455, 206/456, 459.1, 459.5, 460, 467, 470, 206/471, 484, 499, 501, 505, 508, 509, 206/511, 515, 519, 521, 522, 523, 524.1, 206/524.2, 524.9, 252, 527, 541, 545, 206/553, 558, 561, 564, 584, 599, 600, 206/772, 804, 807, 813, 820, 821; 215/11.2, 12.1, 12.2, 211, 212, 213, 215, 215/216, 217, 218, 219, 221, 224, 236, 215/250, 252, 253, 254, 272, 274, 276, 215/310, 330, 331, 334, 341, 354, 355, 215/371, 381, 382, 383, 387, 40, 42, 43, 215/44, 6, DIG. 6

See application file for complete search history.

(56) References Cited

U.S. PATENT DOCUMENTS

| | | | | | |
|---|---|---|---|---|---|
| 4,913,300 | A | | 4/1990 | Wiedmer | |
| 5,040,692 | A | * | 8/1991 | Julian | B65D 55/16 215/258 |
| 5,056,675 | A | * | 10/1991 | Julian | B65D 55/16 215/252 |
| 5,111,947 | A | * | 5/1992 | Patterson | B65D 41/3404 215/256 |
| 5,992,657 | A | * | 11/1999 | Friedman | B65D 50/046 215/209 |
| 6,000,568 | A | * | 12/1999 | Verter | B65D 41/3404 215/230 |
| 2006/0207960 | A1 | * | 9/2006 | Bastero Lopez | B65D 41/3409 215/44 |

FOREIGN PATENT DOCUMENTS

| | | | | | |
|---|---|---|---|---|---|
| FR | 2670465 | A1 | * | 6/1992 | B65D 41/3409 |
| KR | 20060090211 | | * | 8/2006 | B65D 55/16 |
| KR | 20060090211 | A | | 8/2006 | |
| WO | WO-9528334 | A1 | * | 10/1995 | B65D 41/3404 |
| WO | WO-9626122 | A1 | * | 8/1996 | B65D 41/3428 |

* cited by examiner

CONTAINER CLOSURE

CROSS-REFERENCE TO RELATED APPLICATIONS

This application is a national phase entry under 37 U.S.C § 371 of PCT/EP2020/056947 filed Mar. 13, 2020, which claims priority to Swiss Patent Application No. 00326/19 filed Mar. 15, 2019, the entirety of each of which is incorporated by this reference.

FIELD OF THE INVENTION

The invention relates to a container closure, to a pouring element, and to a closure cap.

PRIOR ART

Closure caps which are captively held on the container and close the pouring opening thereof are known from the prior art in the field of plastics closure caps having a tamper-evident band. The holding function is also important since legal regulations are being prepared under which closures of beverage bottles must be connected captively to the beverage bottle even when in the open state.

DE 93 18 243 U1 discloses a captive closure cap of this kind for closing a container. Once the threaded part of the cap is unscrewed, it is held on the tamper-evident band by a catch band. When the closure cap is in the closed state, the catch band is integrated in the tamper-evident band. The tamper-evident band must therefore have an increased height corresponding to the sum of the height of a conventional tamper-evident band and the height of the catch band. The increased height therefore inevitably leads to increased material use when manufacturing a corresponding closure cap.

ADVANTAGES OF THE INVENTION

On the basis of the disadvantages of the above-described prior art, an advantage of the invention is a captive closure cap for which the amount of material used differs only slightly from the amount used for a conventional closure cap having a tamper-evident band.

A further advantage is to a captive closure cap that is not obstructive whenever the container to be closed is in use.

SUMMARY OF THE INVENTION

A container closure is achieved by the features stated in the independent claims. The dependent claims set out developments and/or advantageous alternative embodiments.

The invention comprises a tamper-evident band having a first and a second end, the first end being fixed to the open periphery of the threaded part and the second end being able to be connected to the pouring element. The closure cap is therefore captively held on the pouring element after being unscrewed from the pouring element. This solution allows the tamper-evident band to have a low height and accordingly means little plastics material is required in order to produce the tamper-evident band or the closure cap. In known solutions for captively holding the closure cap on the pouring element, it is necessary to have a retaining band that is separated from the tamper-evident band. The height of the tamper-evident band must therefore be increased compared with other tamper-evident bands that do not have a function of holding the closure cap. This leads to an increased use of material, possibly twice as much as in conventional tamper-evident bands.

In a further embodiment of the invention, the second end of the tamper-evident band can be interlockingly connected to the pouring element. The connection can be produced automatically by rotating the closure cap and, once established, can be released again only with destruction. Therefore, the closure cap is reliably held on the pouring element after opening.

It has proven to be particularly advantageous if a first hook is formed on the second end of the tamper-evident band and can be latched in at least one first recess provided on the pouring element and facing the first hook. Configuring the second end as a hook makes it possible for the connection between the tamper-evident band and the pouring element to be produced automatically as a result of the closure cap being rotated in the opening direction, without any further manual step being necessary to establish the connection. As a result of the connection, a shear force can act on the tamper-evident band during rotation of the closure cap and leads to breaking of the predetermined breaking lugs. After the closure cap is opened, it is suspended from the pouring element by means of the tamper-evident band.

The pouring element expediently has a neck and a collar adjoining the neck. This formation is customary for pouring elements and has the additional advantage that the first recess can be formed on either the neck or the collar.

It has proven to be advantageous if the at least one first recess is formed on the neck in such a way that the first recess is located in a plane oriented orthogonally to the collar and to the neck. As a result, the first recess is oriented exactly such that the first hook is inevitably rotated into the first recess when the closure cap is rotated.

In a further embodiment of the invention, the at least one first recess is formed on the collar such that the first recess is located in a plane oriented orthogonally to the collar and to the neck. In this embodiment as well, the first hook is inevitably rotated into the first recess. Whether the first recess is formed on the collar, the neck, or at the transition between the neck and the collar depends on the configuration of the first hook. It is essential that the hook is automatically rotated into the first recess and does not miss said recess and is not rotated past the first recess outside it.

In a further embodiment of the invention, a cut-out is formed at the transition from the first end to the second end of the tamper-evident band in such a way that the first hook can be rotated into the at least one first recess when the threaded part is rotated in the opening direction. By cutting or punching out the cut-out, the first hook can be produced in any desired shape. At the same time, the cut-out separates the first end from the second end of the tamper-evident band.

In a further embodiment of the invention, at least one guide element is formed on the neck and guides the first hook into the at least one first recess when the threaded part is rotated in the opening direction. When the closure cap is rotated, the hook is forcibly guided and is reliably pressed into the first recess by the guide element.

It has proven to be expedient for the guide element to be a ramp-like projection on which the first hook can be guided downward in the direction of the at least one first recess by rotating the threaded part in the opening direction. The ramp shape can be easily removed from the mold during production and ensures precise forced guidance of the first hook.

To ensure that the first hook is not guided past the first recess by the guide element, the at least one first recess may be formed on the collar in such a way that the first recess is located in the plane of the collar.

Expediently, a barb is formed within the at least one first recess and can be hooked inseparably to the first hook. The barb ensures that the tamper-evident band is firmly held on the pouring element and can no longer detach. As a result, the closure cap is captively held on the pouring element. It is self-evident that the connection between the first hook and the first recess can be released by applying increased force leading to the destruction of the first hook. In principle, however, the container is intended to be disposed of together with the closure cap after use.

In yet another embodiment, the first end and the second end of the tamper-evident band are connected to a tamper-evident lug, which tamper-evident lug breaks when the threaded part is rotated in the opening direction. The tamper-evident lug reliably indicates whether or not the original seal of the container closure is intact. It is conceivable that the breaking of the predetermined breaking lugs when the closure cap is opened may be avoided by manipulation. For this reason, the tamper-evident lug provides further quality assurance for the container closure. The tamper-evident lug may be arranged at the lower periphery of the tamper-evident band. However, the tamper-evident lug may also connect the first and second ends of the tamper-evident band at another point, for example at the top periphery of the tamper-evident band. It is essential that the tamper-evident lug breaks when the closure cap is rotated or the tamper-evident band is manipulated.

In a further embodiment of the invention, a second recess is provided on the second end of the tamper-evident band and can be latched to at least one second hook which is formed on the pouring element and faces the second recess. This embodiment provides another option for fastening the tamper-evident band to the pouring element while the closure cap is being untwisted. In principle, this embodiment is based on the same principle of operation as the embodiments described above.

It is advantageous if the second recess can be hooked on the at least one second hook when the threaded part is rotated in the opening direction. Thereby, this embodiment also provides an automatic connection between the tamper-evident band and the pouring element as a result of the rotation of the closure cap.

The at least one second hook is expediently formed on the neck. In this position, the second hook is oriented such that the second opening is reliably hooked on the second hook as a result of the rotation of the closure cap.

In a further embodiment of the invention, the neck is devoid of a retaining ring for holding the tamper-evident band on the pouring element. Since the tamper-evident band is held on the pouring element by its second end and consequently, as described above, the predetermined breaking lugs break, the container closure does not require any further device that holds the tamper-evident ring back when the closure cap is opened. The option to omit the retaining ring allows for a significant reduction of plastics material when producing the pouring element.

It has proven to be advantageous if the pouring element is intended for being fastened to a beverage carton or to a container made of a composite material, or is intended to be an integral part of a plastics container. As a result, the container closure can be used on almost all known beverage containers. The device features described above can be implemented using conventional production methods. In particular, the first hook and the first recess interacting therewith can be implemented without relatively great effort during the production of the closure cap and the pouring element.

A further aspect of the invention relates to a pouring element having one or more of the features described above. The pouring element interacts with a separately manufactured closure cap, which is adapted to the pouring element so that the closure cap is held on the pouring element by the tamper-evident band.

A further aspect of the invention relates to a closure cap having one or more of the features described above. The closure cap interacts with a separately manufactured pouring element, which is adapted to the closure cap so that the closure cap is held on the pouring element by the tamper-evident band.

BRIEF DESCRIPTIONS OF THE DRAWINGS

Figure 2:
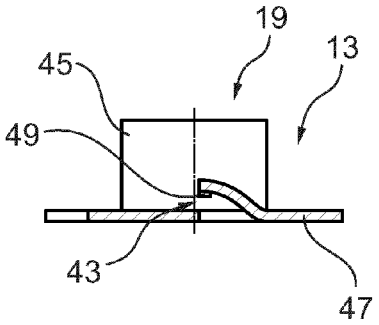
Figure 3:
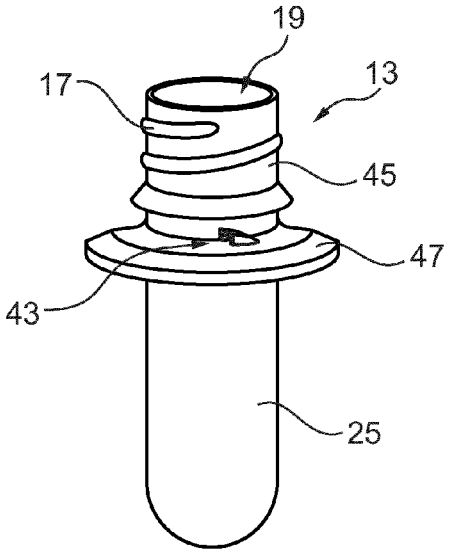
Figure 4:
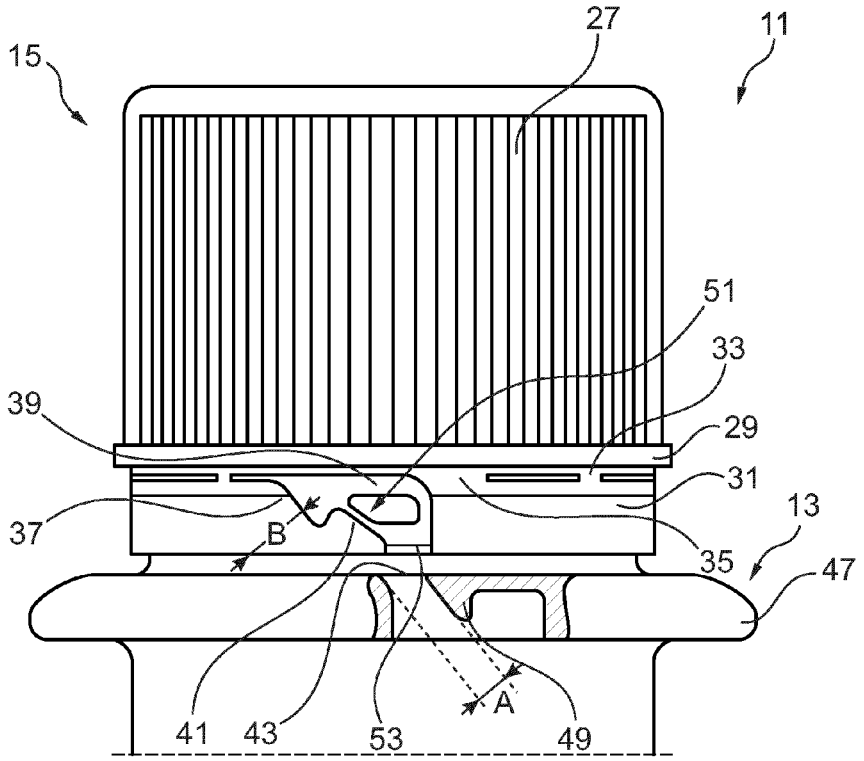
Figure 5:
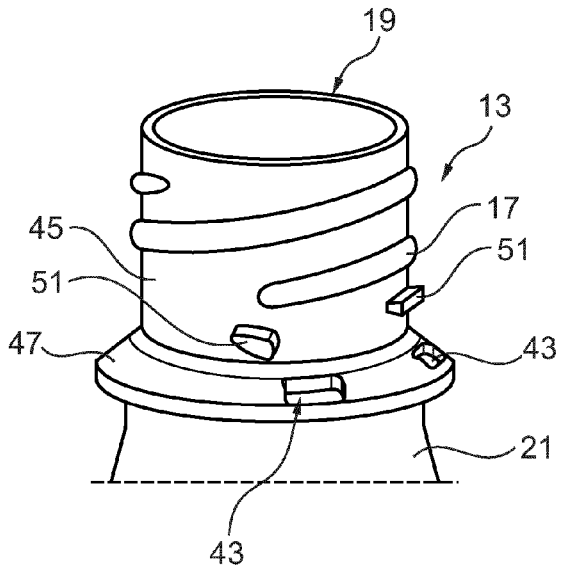
Figure 6:
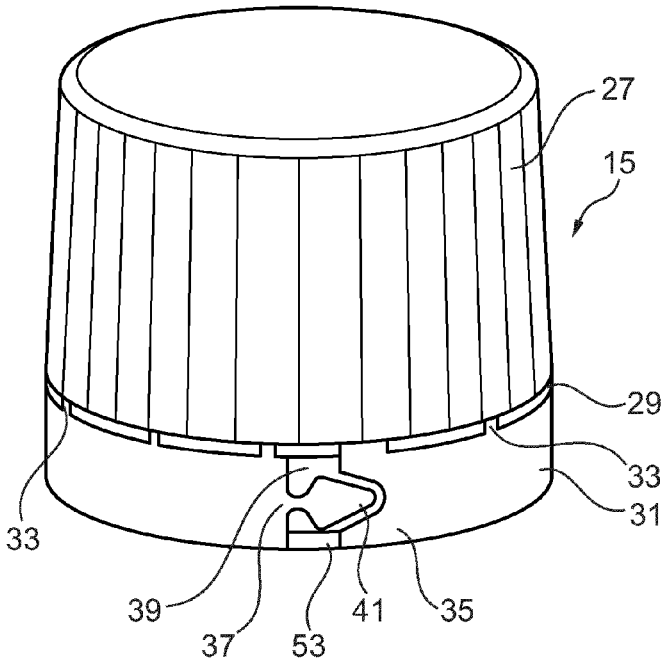
Figure 7:
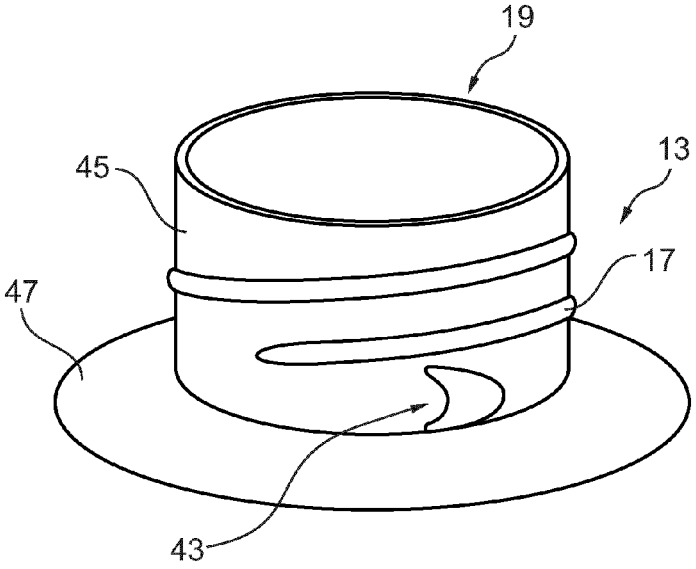
Figure 8:
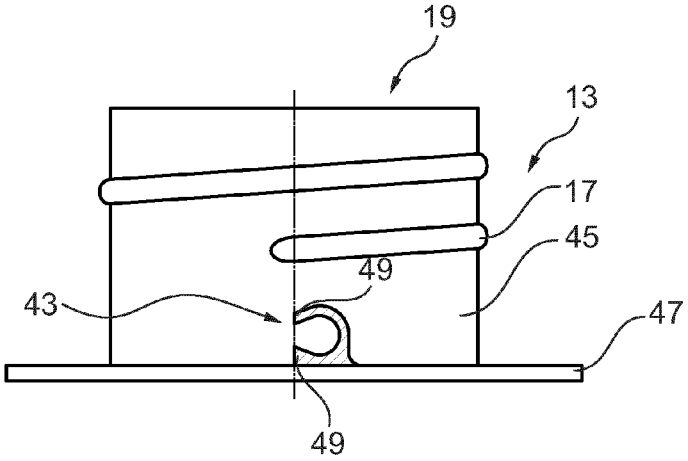
Figure 9:
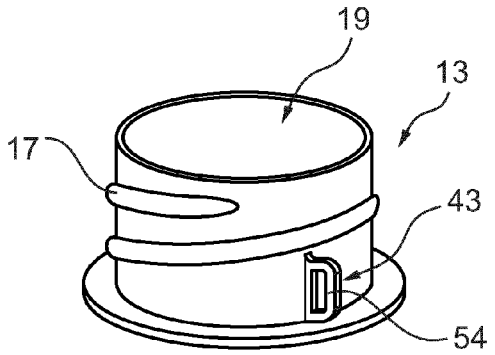
Figure 10:
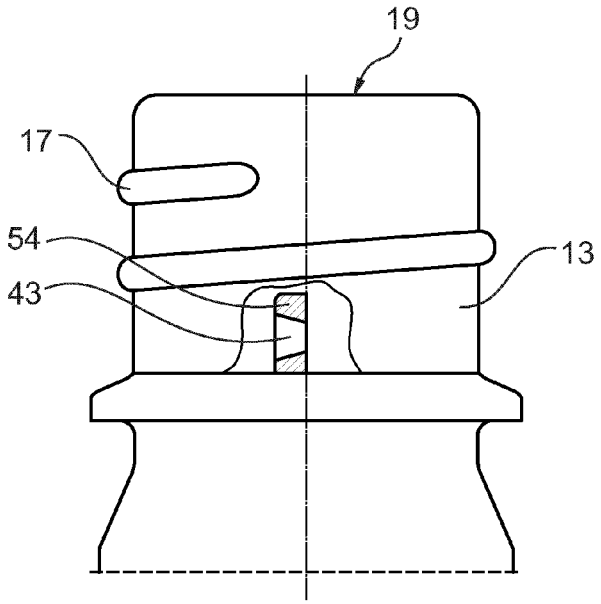
Figure 11:
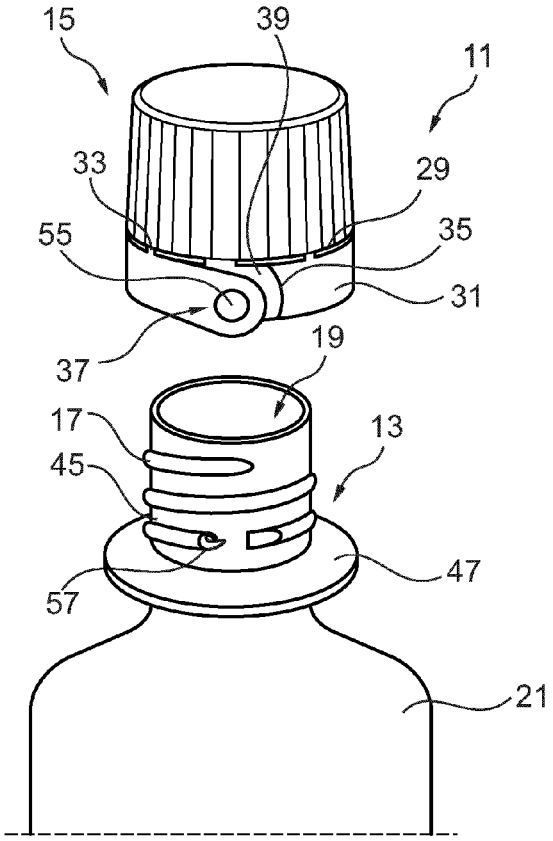

Further advantages and features become apparent from the following description of seven exemplary embodiments of the invention with reference to the schematic drawings. The drawings show, in a representation not true to scale:

FIG. 1: a perspective view of a first embodiment of a container closure having a pouring element and a closure cap, the pouring element being fastened to a beverage carton;

FIG. 2: a sectional view of the pouring element from FIG. 1;

FIG. 3: a second embodiment of the container closure in which the pouring element is formed on a preform;

FIG. 4: a side view of a third embodiment of the container closure;

FIG. 5: a perspective view of the pouring element of FIG. 4;

FIG. 6: a perspective view of a closure cap of the container closure in a fourth embodiment;

FIG. 7: a perspective view of a pouring element in a fifth embodiment, which interacts with the closure cap of FIG. 6;

FIG. 8: a side view of the pouring element from FIG. 7, a recess formed thereon being shown in a sectional view;

FIG. 9: a perspective view of a pouring element in a sixth embodiment, which interacts with the closure cap of FIG. 6;

FIG. 10: a side view of the pouring element from FIG. 9, a ring formed thereon being shown in a sectional view; and FIG. 11: a perspective view of a seventh embodiment of the container closure.

DETAILED DESCRIPTION OF THE INVENTION

FIGS. 1, 4, and 11 show a container closure, which is denoted as a whole by reference sign 11. The container closure 11 comprises a pouring element 13 and a closure cap 15. An external thread 17 is formed on the outside of the pouring element 13. The pouring element 13 encloses a pouring opening 19 through which the contents of a container can be poured. The container can be a plastics container 21 or a beverage carton 23. The plastics container can be manufactured from a preform 25. In the case of a plastics container 21, the pouring element 13 is an integral part of the plastics container 21 and consists of the same material as the entire plastics container. In the case of a beverage carton 23, which can be made of a composite material, the pouring element 13 is fastened, for example glued, thereto.

The closure cap 15 has a cylindrical threaded part 27. The cylindrical threaded part 27 has an internal thread (not visible in the figures), which interacts with the external thread 17. The closure cap 15 can therefore be screwed onto the pouring element 13 and, when in the screwed-on state, closes the pouring opening 19. The cylindrical threaded part 27 has an open periphery 29 which faces the pouring element 13. 1. The closure cap is made of a plastics material, such as PP or HDPE.

Arranged on the open periphery 29 is a tamper-evident band 31 which fulfills the purpose of indicating whether or not the original seal of the container closure 11 is intact. The tamper-evident band 31 is fastened to the open periphery 29, in a known manner, by a plurality of predetermined breaking lugs 33. When the closure cap 15 is rotated in the opening direction relative to the pouring element 13, the predetermined breaking lugs 33 break. When the container closure 11 is in the closed state, the broken or torn predetermined breaking lugs 33 show that the container closure 11 has already been opened.

The aim of the invention is to ensure that the closure cap 15 is captively held on the pouring element 13 even after it has been unscrewed from the pouring element 13, and that as little material as possible is required for the proposed solution.

The tamper-evident band 31 has a first end 35 and a second end 37. Unlike a tamper-evident band in accordance with the prior art, which is a ring not having a first and second end, the present tamper-evident band 31 has a cut-out 39. The first end 35 is formed on one side of the cut-out 39 and the second end 37 is formed on the opposite side of the cut-out 39. The first end 35 is fixed to the open periphery 29. The term "fixed" refers to a connection which does not break off when the closure cap 15 is opened. Therefore, the closure cap 15 remains connected to the tamper-evident band 31 even when the closure cap 15 is unscrewed from the pouring element 13. By way of example, the first end 35 can be fastened to the open periphery 29 by a lug.

In a first embodiment in accordance with FIGS. 1 and 2, a first hook 41 is formed on the second end 37. The first hook 41 is intended to be able to be latched in a first recess 43. The first recess 43 is arranged and formed on the pouring element 13 in such a way that the first hook 41 can be latched in the first recess 43. The pouring element 13 has a neck 45 and a collar 47 adjoining the neck. In FIGS. 1 and 2, the recess 43 is formed on the collar 47 at the transition from the neck 45 to the collar 47. If the closure cap 15 is rotated in the opening direction, that is to say usually counterclockwise, the first recess is arranged on the collar 47 in such a way that the first hook 41 must enter the first recess 43. The recess 43 is therefore located in a plane which is oriented orthogonally to the neck 45 and to the collar 47 or oriented transversely to the first hook 41. As shown in FIG. 2, a protrusion 49 or a barb 49 is formed at the first recess 43, to which protrusion or barb the first hook 41 latches and is held in the first recess in an interlocking manner. When the closure cap 15 is rotated further, the tamper-evident band 31 is subjected to shear and the predetermined breaking lugs 33 break. Once the closure cap 15 has been unscrewed from the pouring element 13, the closure cap 15 is therefore captively held on the pouring element 13 by means of the tamper-evident band 31 as a result of the interaction between the first hook 41 and the first recess 43. Once latched in the first recess 43, the first hook 41 can be removed again from the first recess 43 only with destruction.

It is self-evident that the pouring element 13 together with the first recess 43 can also be formed on the preform 25 (FIG. 3) and is an integral part of the preform 25. In the event of stretch blow molding, for example to form the plastics container 21, the pouring element 13 remains unchanged and interacts with the closure cap 15 just as in the embodiment in accordance with FIGS. 1 and 2.

In the third embodiment in accordance with FIGS. 4 and 5, at least one guide element in the form of a ramp-like projection 51 is formed on the neck 45. In this embodiment, the first recess 43 is located in the plane of the collar 47 or is provided within the collar. When the closure cap 15 is rotated in the opening direction, the first hook 41 is guided downward along the projection 51 in the direction of the first recess 43 and is pressed into the first recess 43. The hook 41 latches with the barb 49 in the first recess.

FIG. 4 shows that the first and second ends 35, 37 of the tamper-evident band 31 are connected to a tamper-evident lug 53. When the first hook 41 is forced downward by the projection 51, the tamper-evident lug 53 tears and indicates that the original seal of the container closure 11 is no longer intact. The tamper-evident band 53 is provided in the third embodiment since it is conceivable to remove the closure cap 15 from the pouring element 13 without the predetermined breaking lugs 33 being destroyed. In FIG. 4, the width of the first recess 43 in the region of the barb 49 is denoted by "A". The width of the first hook 41 at the transition to the tamper-evident band 31 is denoted by "B". Since the width B is greater than the width A, the barb 49 is pressed upward by the first hook 41 and pretensioned when the first hook 41 is rotated into the first recess 43. As a result, the first hook 41 is reliably held in the first recess 43.

If a multi-start external thread 17 is provided on the pouring element 13, one first recess 43 and one projection 51 are provided per thread so that in any case the first hook 41 hooks in one of the first openings 43 when the closure cap 15 is opened.

In a fourth embodiment in accordance with FIG. 6, the first hook 41 is formed such that it is not guided downward in the direction of the collar 47 but rather toward the side in the direction of the neck 45. In this case, the first recess 43 is formed on the neck 45 in such a way that the recess is located in a plane oriented orthogonally to the collar 47 and to the neck 45. As shown in FIG. 7, the orientation of the first recess 43 allows the first hook 41 to be rotated into the first recess 43 when the closure cap 15 is rotated in the opening direction. The first hook 41 hooks into the barb 49, as shown by the sectional view in FIG. 8. This embodiment is particularly suitable for pouring elements 13 which are made of LDPE since the recess 43 can be produced in an extrusion blow molding process, after which extrusion blow molding process the LDPE is processed.

As shown in FIGS. 9 and 10, the first recess 43 can also be enclosed by a ring 54, which ring is formed on the neck 45. When the first hook 41 is rotated, it is pressed into the ring 54 and hooks into the ring 54. So that the first hook 41 can hook in the ring 54, the ring has a conical recess 43 which tapers away from the first hook 41. This embodiment is particularly suitable for pouring elements 13 which are made of PET since the ring 54 can be injection-molded and can therefore be produced from PET when a preform is injection-molded.

In a further embodiment in accordance with FIG. 11, a second recess 55 is provided at the second end 37. A second hook 57 is formed on the neck 45. When the closure cap 15 is rotated in the opening direction, the second recess 55 hooks to the second hook 57. As a result, after being unscrewed, the closure cap 15 is held on the pouring element 13 by the tamper-evident band 31.

Since the tamper-evident band 31 is held on the pouring element 13 at its second end 37, other devices that hold the tamper-evident band 31 on the pouring element 13 can be dispensed with. A retaining ring, which encloses the pouring element in the circumferential direction and makes it possible to retain the tamper-evident band on the pouring element when the closure cap is unscrewed, is known from the prior art. In accordance with the present invention, a retaining ring of this kind on the pouring element can be dispensed with. This makes it possible to reduce the plastics material required for the retaining ring.

The invention claimed is:

1. Container closure comprising:

a pouring element that merges into a container body or configured to be fastened to a container body, at least one external thread formed on the pouring element, and a closure cap for closing a pouring opening within the pouring element, the closure cap comprising:

a cylindrical threaded part having an open periphery and an internal thread that interacts with the external thread of the pouring element, a tamper-evident band connected to the open periphery of the threaded part by a plurality of predetermined breaking lugs, opening of the container closure for the first time being evident from the breaking of the plurality of predetermined breaking lugs, the tamper-evident band having a first and a second end, wherein the first end is fixed to the open periphery of the threaded part and the second end is configured to be connected to the pouring element, a first hook formed on the second end of the tamper-evident band and configured to be latched in at least one first recess provided on the pouring element and facing the first hook, wherein a transition from the first end to the second end of the tamper-evident band defines a cut-out and the first hook can be rotated into the at least one first recess when the threaded part is rotated in an opening direction.

2. Container closure according to claim 1, wherein the first end and the second end of the tamper-evident band are connected to a tamper-evident lug, the tamper-evident lug breaking when the threaded part is rotated in the opening direction.

3. Container closure according to claim 1, wherein the second end of the tamper-evident band is configured to be interlockingly connected to the pouring element.

4. Container closure according to claim 1, wherein the pouring element has a neck and a collar adjoining the neck.

5. Container closure according to claim 4, wherein the at least one first recess is formed on the neck in such a way that the recess is located in a plane oriented orthogonally to the collar and to the neck.

6. Container closure according to claim 4, wherein the at least one first recess is formed on the collar in such a way that the recess is located in a plane oriented orthogonally to the collar and to the neck.

7. Container closure according to claim 4, further comprising at least one guide element on the neck guiding the first hook into the at least one first recess when the threaded part is rotated in the opening direction.

8. Container closure according to claim 7, wherein the guide element is a ramp-like projection on which the first hook can be guided downward in a direction of the at least one first recess by rotating the threaded part in the opening direction.

9. Container closure according to claim 4, wherein the at least one first recess is formed on the collar in such a way that the first recess is located in a plane of the collar.

10. Container closure according to claim 1, further comprising a barb within the at least one first recess and configured to be hooked to the first hook.

11. Container closure according to claim 1, further comprising a second recess on the second end of the tamper-evident band and configured to be latched to at least one second hook which is formed on the pouring element and faces the second recess.

12. Container closure according to claim 11, wherein the second recess is configured to be hooked on the at least one second hook when the threaded part is rotated in the opening direction.

13. Container closure according to claim 11, wherein the at least one second hook is on the neck.

14. Container closure according to claim 4, wherein the neck is devoid of a retaining ring for holding the tamper-evident band on the pouring element.

15. Container closure according to claim 1, wherein the pouring element is configured to be fastened to a beverage carton or to a container made of a composite material.

16. Container closure according to claim 1, wherein the pouring element is an integral component of a plastics container.

17. Container closure comprising:

a pouring element that merges into a container body or configured to be fastened to a container body, at least one external thread formed on the pouring element, and a closure cap for closing a pouring opening within the pouring element, the closure cap comprising:

a cylindrical threaded part having an open periphery and an internal thread that interacts with the external thread of the pouring element, a tamper-evident band connected to the open periphery of the threaded part by a plurality of predetermined breaking lugs, opening of the container closure for the first time being evident from the breaking of the plurality of predetermined breaking lugs, the tamper-evident band having a first and a second end, wherein the first end is fixed to the open periphery of the threaded part and the second end is configured to be connected to the pouring element, and a second recess on the second end of the tamper-evident band and configured to be latched to at least one second hook which is formed on the pouring element and faces the second recess.

18. Container closure according to claim 17, wherein the second recess is configured to be hooked on the at least one second hook when the threaded part is rotated in an opening direction.

19. Container closure according to claim 17, wherein the at least one second hook is on a neck of the pouring element.

20. Container closure comprising:

a pouring element configured to be fastened to a beverage carton or to a container made of a composite material, at least one external thread formed on the pouring element, and a closure cap for closing a pouring opening within the pouring element, the closure cap comprising:

a cylindrical threaded part having an open periphery and an internal thread that interacts with the external thread of the pouring element, a tamper-evident band connected to the open periphery of the threaded part by a plurality of predetermined breaking lugs, opening of the container closure for the first time being evident from the breaking of the plurality of predetermined breaking lugs, the tamper-evident band having a first and a second end, wherein the first end is fixed to the open periphery of the threaded part and the second end is configured to be connected to the pouring element, and a first recess on the second end of the tamper-evident band and configured to be latched to at least one first hook which is formed on the pouring element and faces the recess.

21. Container closure according to claim 20, further comprising a second hook formed on the second end of the tamper-evident band and configured to be latched in at least one second recess provided on the pouring element and facing the second hook, wherein a transition from the first end to the second end of the tamper-evident band defines a cut-out and the second hook can be rotated into the at least one second recess when the threaded part is rotated in the opening direction.

22. Container closure according to claim 20, wherein the first recess is configured to be hooked on the at least one first hook when the threaded part is rotated in the opening direction.

23. Container closure according to claim 20, wherein the at least one first hook is on a neck of the pouring element.

* * * * *